US005997052A

United States Patent [19]

Reeb et al.

[11] Patent Number: 5,997,052

[45] Date of Patent: Dec. 7, 1999

[54] LOCKING MECHANISM FOR CONTAINER LID

[76] Inventors: David Lee Reeb, 2485 Vinyard La., Crofton, Md. 21114; Walter Paul Robinette, II, 5734 Lockborn Rd., Lockborn, Ohio 43137

[21] Appl. No.: 08/921,316

[22] Filed: Aug. 29, 1997

Related U.S. Application Data

[63] Continuation-in-part of application No. 08/492,729, Jun. 20, 1995, Pat. No. 5,662,364.

[51] Int. Cl.[6] ..... E05B 39/02

[52] U.S. Cl. ..... 292/148; 292/230; 292/DIG. 4

[58] Field of Search ..... 220/315; 292/DIG. 4, 292/230, 231, 232, 233, 236, 237, 148, 234, 235, 238, 239

[56] References Cited

U.S. PATENT DOCUMENTS

| | | | |
|---|---|---|---|
| 4,182,530 | 1/1980 | Hodge | 294/73 |
| 5,042,856 | 8/1991 | Goodman | 292/259 R |
| 5,085,341 | 2/1992 | Hodge | 220/331 |
| 5,090,753 | 2/1992 | Goodman | 292/230 |
| 5,094,358 | 3/1992 | Serio, Sr. | 220/315 |
| 5,118,000 | 6/1992 | Howell et al. | 220/315 |
| 5,201,434 | 4/1993 | DeVivo et al. | 220/315 |
| 5,415,314 | 5/1995 | McCollum | 220/315 |
| 5,419,598 | 5/1995 | Dreitzer | 292/230 |
| 5,474,341 | 12/1995 | Putman et al. | 292/230 |
| 5,599,050 | 2/1997 | Tinsley | 292/230 |
| 5,683,126 | 11/1997 | DeVivo et al. | 292/230 |

*Primary Examiner*—Darnell M. Boucher
*Assistant Examiner*—Clifford B Vaterlaus
*Attorney, Agent, or Firm*—Liniak, Berenato, Longacre & White

[57] ABSTRACT

The invention is directed to a lock releasing mechanism for a container having a hinged or removable lid. A locking arm is disposed adjacent the container lid to prevent an opening of the lid, and a cable, or rigid bar, connects the locking arm to the locking mechanism. The elements of the locking mechanism comprise a slide plate to which the cable is fixed; a spring for urging the slide plate to a locked position, a guide member for guiding the slide plate, and a trigger ball which blocks movement of the slide arm in the locked position. When the container is tilted forward by a predetermined angle, the trigger ball becomes dislodged from the locking position to enable movement of the slide plate, and subsequent movement of the locking arm. When the locking arm is moved out of the path of travel for the container lid, the contents of the container may be removed. In one embodiment, a stop is provided to limit rotation of the locking bar to prevent contact with the container lid.

6 Claims, 10 Drawing Sheets

LOCKING MECHANISM FOR CONTAINER LID

This is a continuation-in-part application of U.S. Ser. No. 08/492,729 filed Jun. 20, 1995, now U.S. Pat. No. 5,662,342.

FIELD OF THE INVENTION

The present invention relates to the field of lock releasing mechanisms for container lids. Specifically, the invention relates to an automatic pivoting locking mechanism for automatically locking and unlocking the access openings of dumpster containers.

BACKGROUND OF THE INVENTION

Many container lid locking mechanisms have been proposed. An example of a container lid locking system is disclosed in U.S. Pat. No. 4,534,488. While the many prior art container lid locking mechanisms have their uses, several shortcomings have become evident with respect to efficiently and effectively locking lids on large containers. Specifically, in the field of locking container lids for trash receptacles, there are few simple locking mechanisms, and even fewer retrofit mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from the trash removal service. These receptacles are not provided free of charge, and consequently their frequent emptying and service are sometimes a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a locking mechanism for these containers which is simple and reliable, and which can be retrofitted to a broad variety of containers. Historically, these containers have been formed of an all metal construction, and typically a fairly heavy gauge metal. However, many of the newer containers are of partial plastic construction or are of all plastic construction. Hence, the ability for a user or provider of the receptacle to attach a simple welded locking structure is limited owing to the fact that not all of the parts of the container can accommodate a weld.

Another problem of retrofitting existing containers or providing a broad application type of locking mechanism for variously sized containers is the question of custom sizing application. The solution to accommodating a broad size of containers is to create a locking mechanism which can be changed in dimension while not altering the basic operation of the locking mechanism.

Many containers currently in use have a locking bar extending above a hinged lid, whereby the locking bar is locked in place by a padlock. Trash removal services are required to approach the container, exit the vehicle to unlock the padlock, return to the vehicle to empty the container, exit the vehicle to relock the padlock, then move on to the next container. These container do not permit the automatic locking and unlocking of the container, and require more time to empty.

U.S. Pat. No. 5,094,358 provides a locking mechanism for a container having a hinged or removable lid. The locking mechanism is deactivated by tipping the container, for instance, during the dumping procedure. To achieve this purpose, the locking mechanism is provided with a pivotable swing lever or ball trigger which moves between an interference position whereby opening of the container lid is prevented, and a non-interference position whereby opening of the container lid is permitted.

However, the locking mechanism of U.S. Pat. No. 5,094,358 is fitted on to the front of the container, thus may interfere with the emptying procedure. Specifically, customer access to the container is substantially hampered by the cumbersome and poorly located locking mechanism and locking arm, which interfere with day-to-day customer use. Moreover, for containers having a locking bar originally fitted thereon, the owner must remove the locking bar then retrofit the container with the new locking mechanism and associated L-shaped locking bar. It is further noted that this locking mechanism is too heavy for many plastic containers.

The need therefore exists for a container locking mechanism which overcomes the aforementioned deficiencies in the prior art.

SUMMARY OF THE INVENTION

The present invention seeks to obviate the shortcoming of the prior art container lid locking mechanisms, while at the same time providing a solution to the need for a retrofit locking mechanism for a wide variety of container types, materials, and sizes. In addition, the present invention seeks to improve upon the locking mechanism disclosed in U.S. Pat. No. 5,094,358 by providing a locking mechanism which may be mounted to a container having a locking bar mounted to the container which extends across the hinged lid. Thus, the mechanism of the present invention may be retrofit onto existing containers with minimal modification to the container.

The present invention provides a locking mechanism which securely locks in place a removable or hinged container lid to a container, and which utilizes gravity to effect automatic disengagement of the same.

The container is provided with a locking bar which blocks the container lid from opening. The locking bar is mounted for rotation at the pivot point on the front side of the container. A cable or other connector connects the locking bar to the locking mechanism, whereby the locking mechanism releases the locking bar for rotation when the container is tipped forward by a predetermined angle.

The automatic pivoting locking mechanism of the present invention comprises a housing which is mounted to the side of the container. Fitted within the housing is a slide plate which reciprocates between locking and unlocking positions. A spring member acts on the slide plate to bias the slide plate toward the locking position.

Adjacent the slide plate is a fixed guide member which extends along the reciprocating direction of the slide plate. Both the slide plate and the guide plate are formed with an angled slot sized to receive a blocking member therein, typically formed as a ball trigger.

When the slide plate is in the locking position, the slot in the slide plate is aligned with the slot in the guide plate. In this position, the ball trigger is mutually received in both slots; the slot in the slide plate and the slot in the guide plate. When the ball trigger is in this locking position, the slide plate is prevented from reciprocational movement.

When the container to which the housing is fixed is tipped forward to an angle of approximately 45 degrees, the ball trigger is moved out of the slot in the guide plate by the force of gravity, and the slide plate is consequently permitted to slide into the unlocking position.

During this same forward tipping action, a tension is created on the cable due to the force of gravity acting on the locking bar. Connecting the locking bar to the locking mechanism is a cable which extends from the locking bar to the slide plate. When the container is tipped forward, the force of gravity moves the trigger ball out of the slot in the guide plate, and acts on the locking bar to cause a tension in the cable. The slide member is then permitted to reciprocate to the unlocked position, and the tension in the cable effects movement of the slide arm. As the slide plate moves to the unlocked position, the locking bar pivots to a forward position, thus freeing the container lid to open.

Both the container and lid can be made of a metal or plastic construction, or a combination of metal and plastic or some other light weight material.

In addition, the locking mechanism of the invention is not limited to front loading container, but may be fitted to side loading containers as well.

Customer access to the container is substantially improved by providing a locking bar which may be manually disconnected from the locking mechanism by a padlock. The locking bar may then be easily displaced to enable entry into the container with minimal effort.

The foregoing objectives of the invention will now be described with reference to the following drawings.

DETAILED DESCRIPTION OF THE PREFERRED EMBODIMENTS

Figure 1:
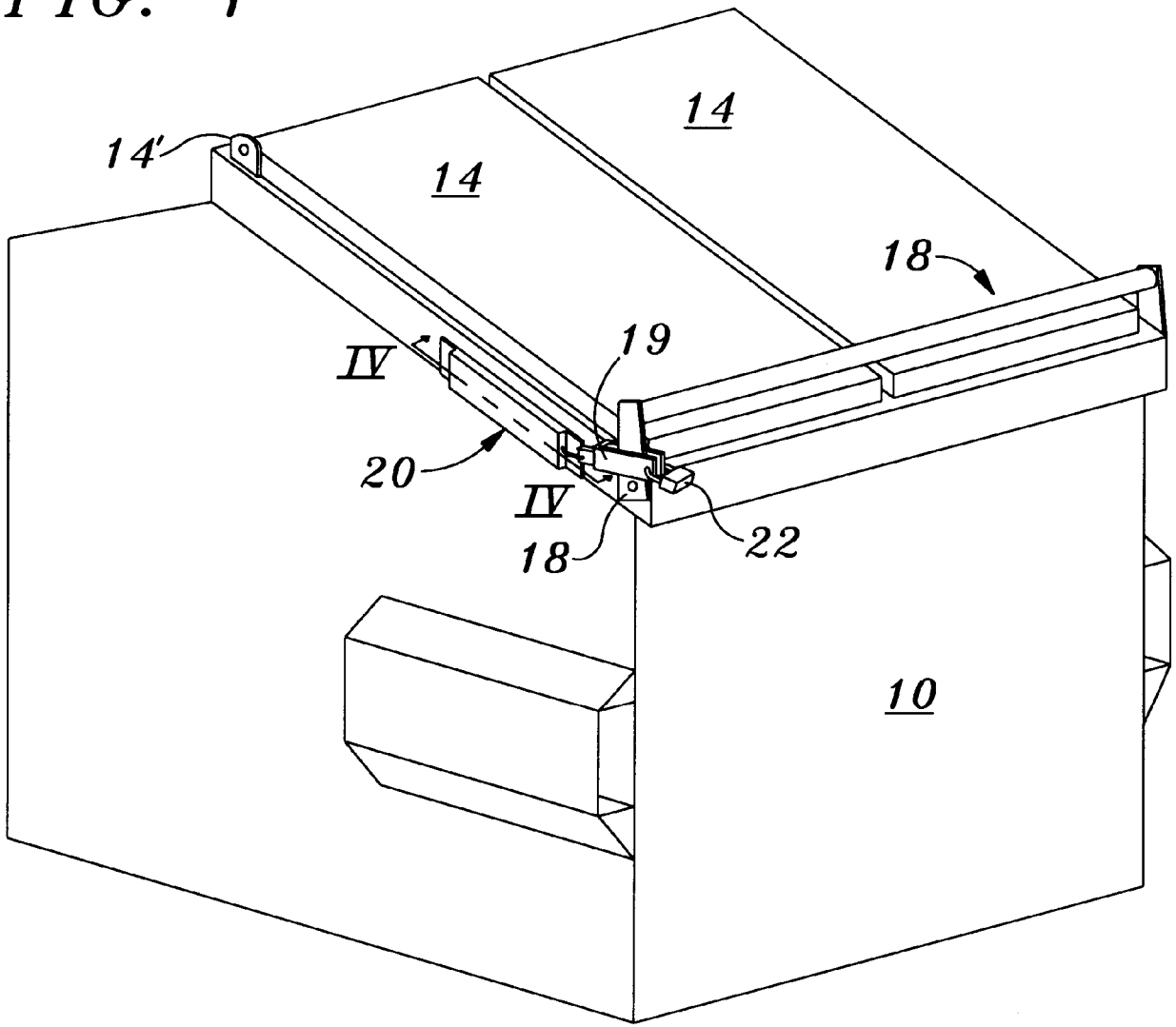
FIG. 1 is an isometric frontal view of a dumpster container and locking mechanism according to the present invention shown in the closed position.
Figure 2:
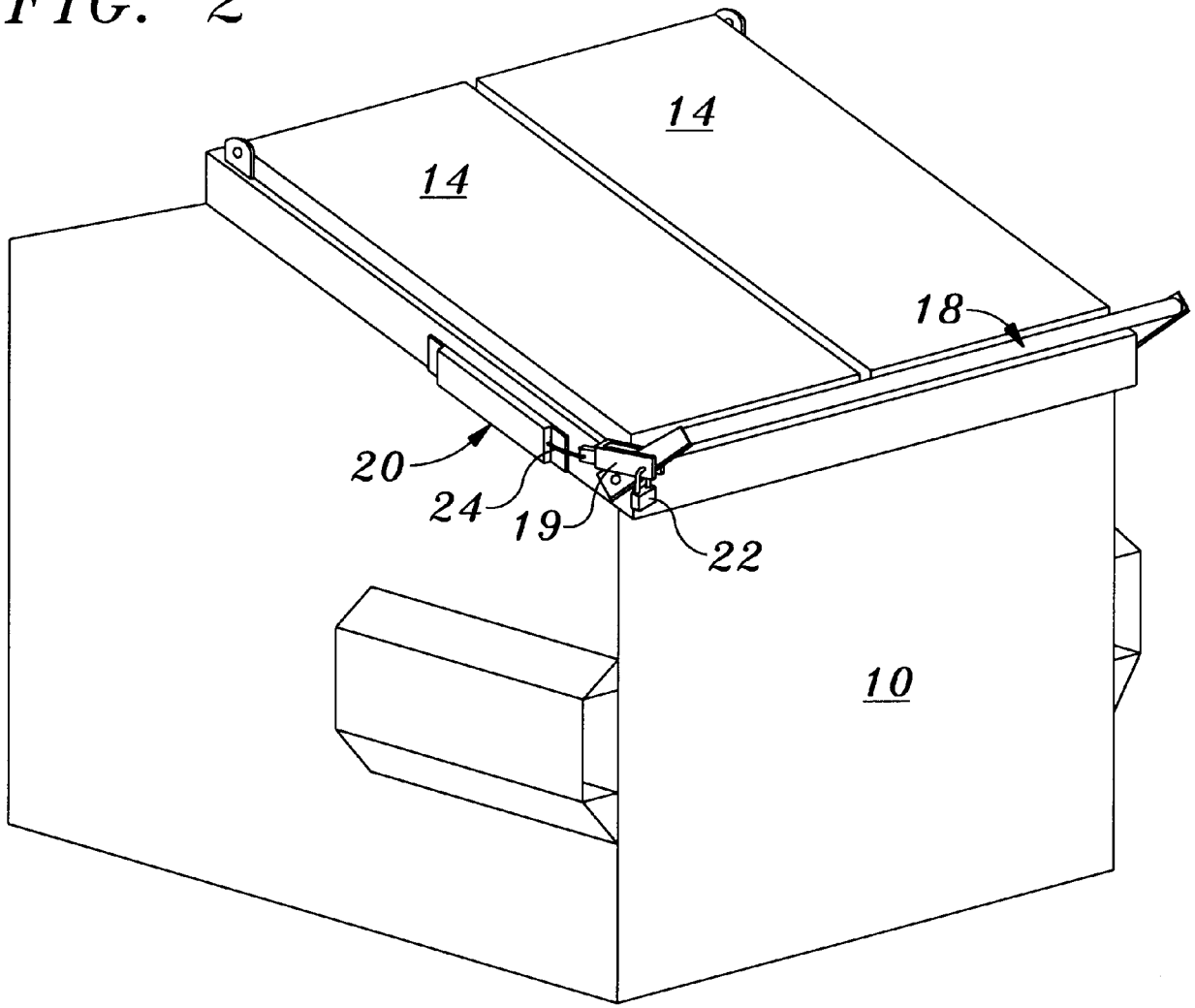
FIG. 2 is an isometric frontal view of the dumpster container of FIG. 1 shown in the open position with the locking bar pivoted forward of the container lid.

With reference to FIGS. 1 and 2, the present invention serves as a locking mechanism on a container 10 of the type illustrated or any container which is emptied by inversion. The container 10 of this type is provided with at least one pivoting lid 14 (two lids shown in FIGS. 1 and 2), and a locking bar 18 which prevents the at least one pivoting lid 14 from opening. The lid 14 pivots about a pivot point 14' in order that the contents of the container 10 may be removed and properly disposed of, and the locking bar extends across the lid 14 to block this pivoting movement. The locking bar 18 is also pivotally supported on the container 10 at a pivot point 18' in order that the bar 18 may be moved out of path of the lid 14 in order that the lid 14 may be opened, and that the contents of the container 10 may be removed.

Figure 3:
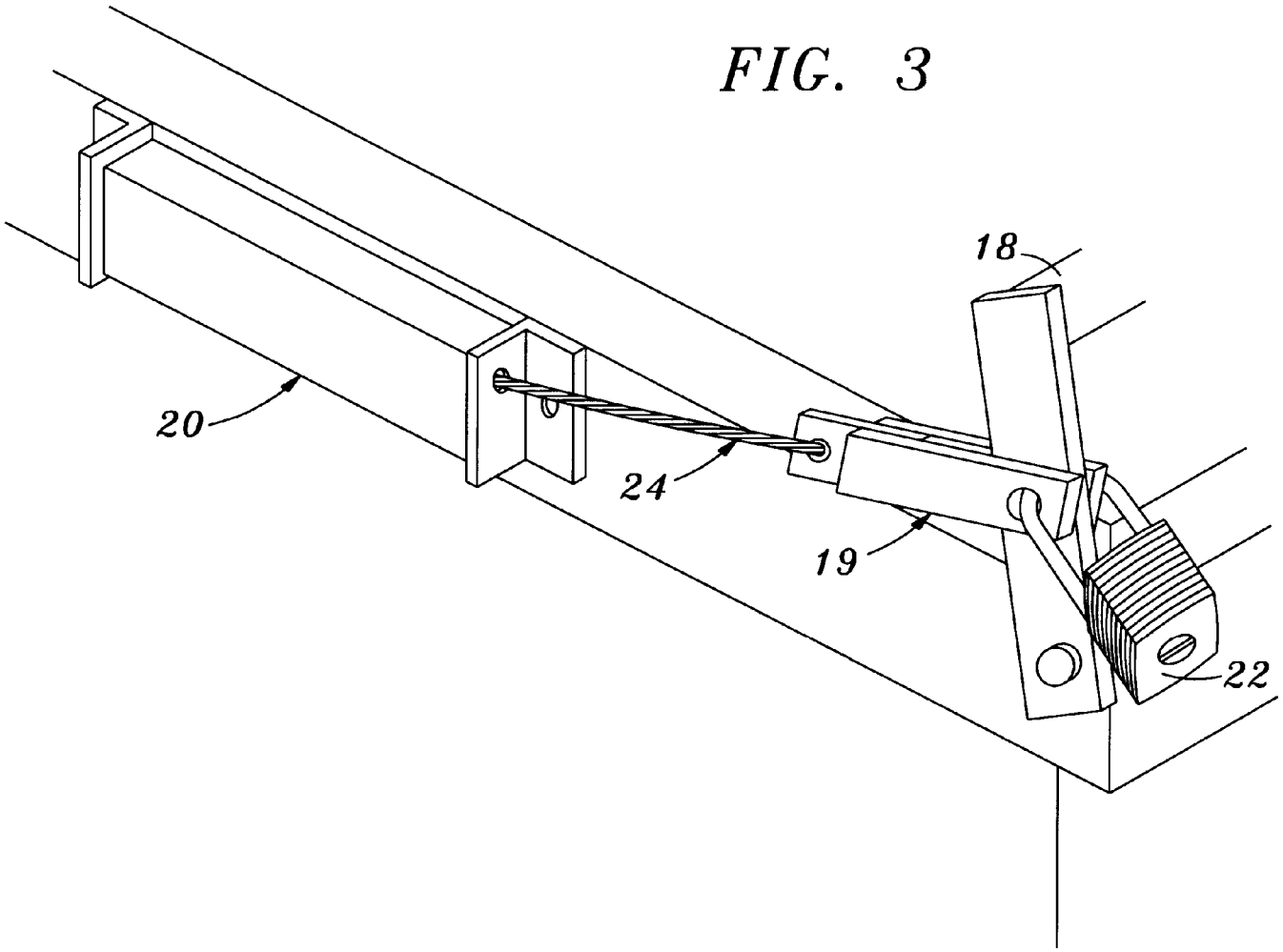
FIG. 3 is an enlarged isometric frontal view of the locking mechanism of FIG. 1 shown in the closed position with the locking bar blocking movement of the container lid.

The locking mechanism of the invention is positioned on the container 10 within the housing 20. Affixed to the locking bar 18 is a cable 24 which extends from within the housing 20 to the connecter 19. The connector 19 removably affixes the cable 24 to the locking bar 18. A padlock 22 may be used to detach the cable 24 from the locking bar 18 to enable manual movement of the bar 18 (see FIGS. 2 and 3). With this arrangement, customer access is substantially simplified to enable easy entry into the container by any authorized user. The housing 20 may be welded to a metal container or may be bolted to the container in a suitable manner.

Figure 4:
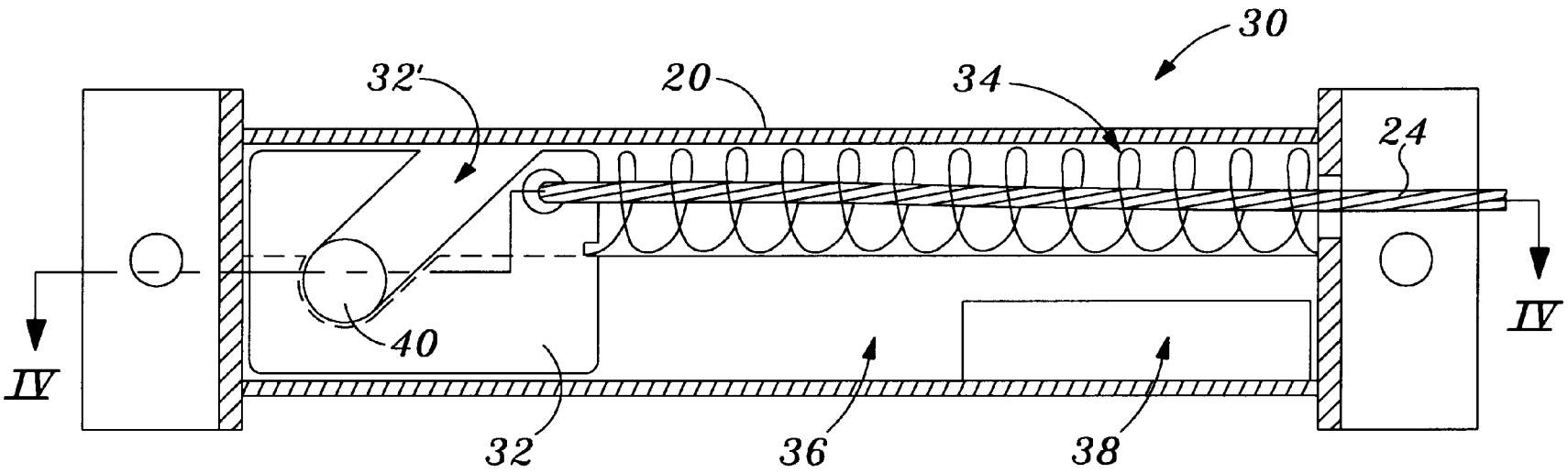
FIG. 4 is a cross-sectional view of the locking mechanism taken along line IV—IV in FIG. 1 showing the locking mechanism in the locking position.
Figure 5:
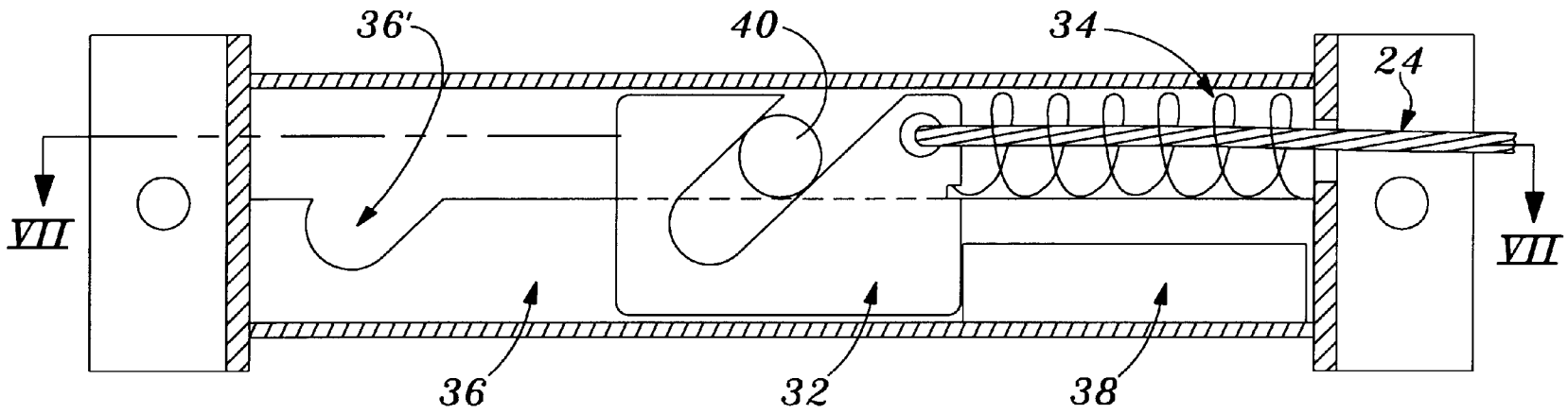
FIG. 5 is the cross-sectional view of FIG. 4 with the locking mechanism in the unlocked position.

Referring more specifically to the working parts of the locking mechanism, FIG. 4 shows an automatic locking mechanism 30 for the dumpster container 10. The automatic locking mechanism 30 comprises a slide plate 32 to which the cable 24 is fixed; a spring 34, a guide member 36, a bumper member 38, and a trigger ball 40. The spring 34 biases the slide plate 32 in the leftward direction as shown in FIG. 4. The guide member 36 guides the slide plate 32 for translational movement between a locked position (FIG. 4) and an unlocked position (FIG. 5). The bumper member 38 cushions the movement of the slide plate 32 in the unlocked position (see FIG. 5), and stops the slide plate 32 in the rightward position. In addition, the bumper 38 preserves the spring 34 and other working parts of the locking mechanism 30.

The trigger ball 40 is fitted within a slot 32' provided in the slide plate 32, and is carried by the slide plate 32 during its translational movement. A corresponding slot 36' (see FIG. 5) is provided in the guide plate 36 in such a manner that when the slide plate 32 is in its leftmost position (FIG. 4), the trigger ball 40 becomes trapped in both slots 32' and 36' to fix the slide plate 32 in the locked position, thus preventing the slide plate 32 from moving in response to tension on the cable 24.

As shown in FIG. 4, the slot 32', the guide member 36 and housing 20 define a retention chamber in which the trigger ball is maintained during movement of the slide plate 32 between the locked and unlocked positions.

When the container 10 is in a substantially level position, the spring 34 resiliently biases a slide plate 32 toward the locked position which is the leftmost position shown in FIG. 4. When the slide plate 32 reaches this leftmost position, the trigger ball 40 is trapped in both slots 32' and 36', and the locking mechanism 30 is placed in the locked position.

If the container 10 is tilted forward, for instance, during a dumping procedure, the locking mechanism is likewise tilted forward. When the locking mechanism 30 is tilted forward to a predetermined angle defined by the annular disposition of the slots 32' and 36' (preferably about 45 degrees), the trigger ball 40 is dislodged from the slot 36' by the force of gravity as shown in FIG. 5. Once the trigger ball 40 is dislodged from the slot 36', the slide plate 32 is free to move in response to a tension on the cable 24.

When the container 10 is tilted forward in this manner, gravity also acts on the locking bar 18 to create a tension on the cable 24. This tension causes the slide plate 32 to move in the rightward direction as shown in FIG. 5. As a result, the locking bar 18 pivots out of the path of the lid 14 as shown in FIG. 2. If the container 10 is further inverted, the lid 14 will open and the contents of the container 10 will be discharged.

Significantly, the present invention not only provides a useful automatic locking device, but further provides a mechanism which serves to automatically lock the lid 14 to prevent unauthorized opening of the container 10. It is noted that the spring 34 is designed and selected to provide a resiliency which may only slightly overcome the weight of the locking bar 18. Thus, the slide plate 32 may remain in rightward position shown in FIG. 5 until the container is slightly jolted by a contact force caused when the container contacts the ground following the emptying procedure. This balance between the weight of the locking bar 18 and the force of the spring 34 ensures that the locking bar will not return to the closed position before the lid 14.

When the container 10 is returned to a substantially level position (and the container is jolted by contact with the ground), the spring 34 once again acts to return the slide plate 32 to the locked position of FIG. 4 where the trigger ball 40 is returned to the slot 36'.

Figure 6:
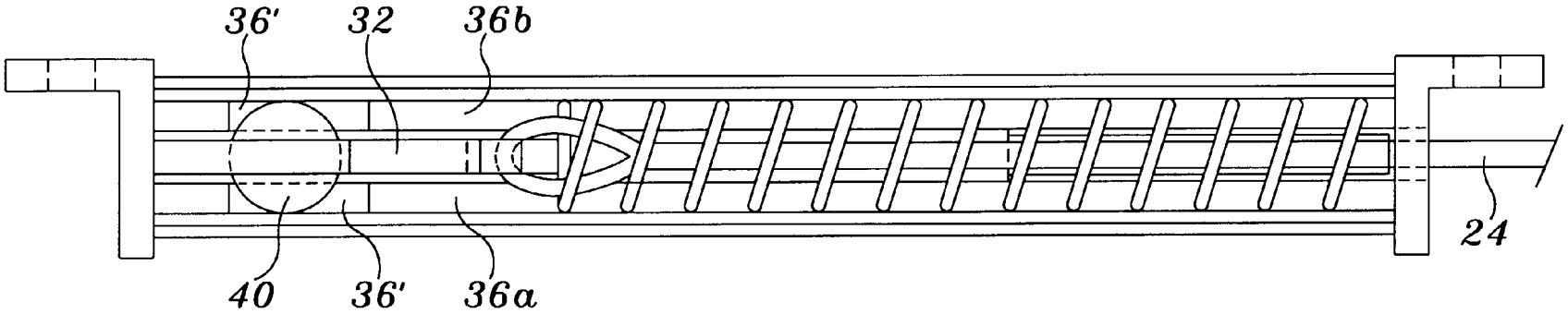
FIG. 6 is a cross-sectional top view of the locking mechanism taken along line VI—VI of FIG. 4 showing the locking mechanism in the locked position.
Figure 7:
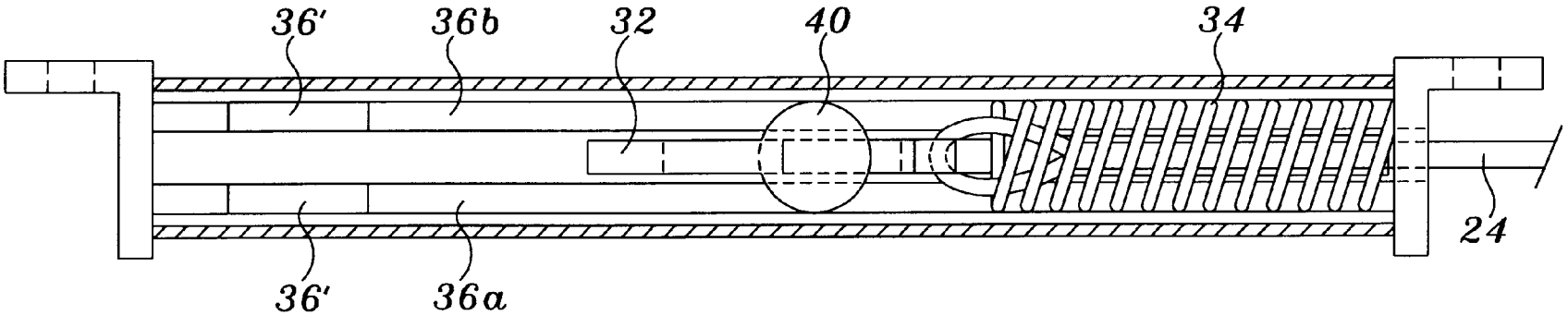
FIG. 7 is a cross-sectional top view of the locking mechanism taken along line VII—VII of FIG. 5 showing the locking mechanism in the unlocked position.
Figure 8:
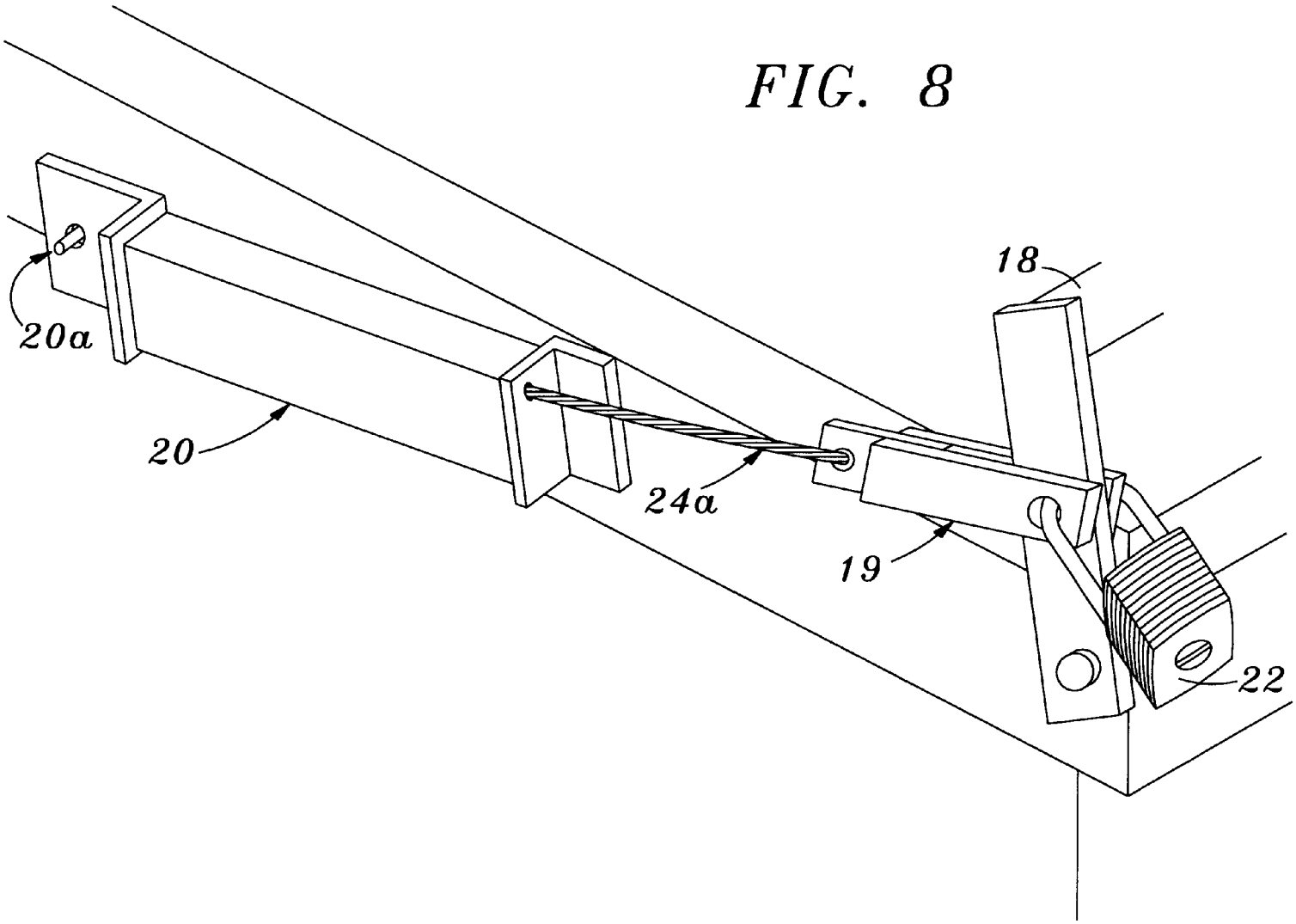
FIG. 8 is an enlarged isometric frontal view of the locking mechanism showing an alternate embodiment wherein the cable 24 is replaced with a rigid rod 24*a* and the housing 20 is pivotally mounted to container 10 at pivot point 20*a*.

FIGS. 6 and 7 provide a top cross-sectional view of the preferred design of the locking mechanism of the present invention. As clearly illustrated by these drawings, the slide plate 32 is retained between two parallel walls 36*a,* 36*b* of the guide member 36. Each of the parallel walls 36*a,* 36*b* is provided with a slot 36' for retaining the trigger ball 40 in the locked position. FIG. 6 illustrates the locking mechanism in the locked position whereby the trigger ball 40 is positioned within both slots 36' and transverses the slide plate 32 through the slot 32'. FIG. 7 illustrates the locking mechanism in the unlocked position whereby the trigger ball 40 is dislodged from the slots 36', and the slide plate 32 is moved in the rightward direction to compress the spring 34. In this position, the trigger ball 40 is carried by the slide plate 32.

As shown in FIGS. 1 and 2, a second lid 14 may be attached to the dumpster container 10, allowing the locking bar 18 to extend securely across the front of the dumpster container 10 and to block movement of both lids 14. Both the dumpster container 10 and its lid(s) 14 may be made out of all metal, or another suitable nonmetal material, such as plastic or other light-weight material.

In an alternate embodiment, the slide plate 32 may be connected to the locking bar through a rigid rod 24*a* which is suitably fastened to the locking bar 18 and slide plate 32 respectively. In this instance, the housing 20 for the locking mechanism 30 may be secured to the container at a single pivot point 20*a* in order to compensate for the lost flexibility previously provided by the cable 24.

Figure 9:
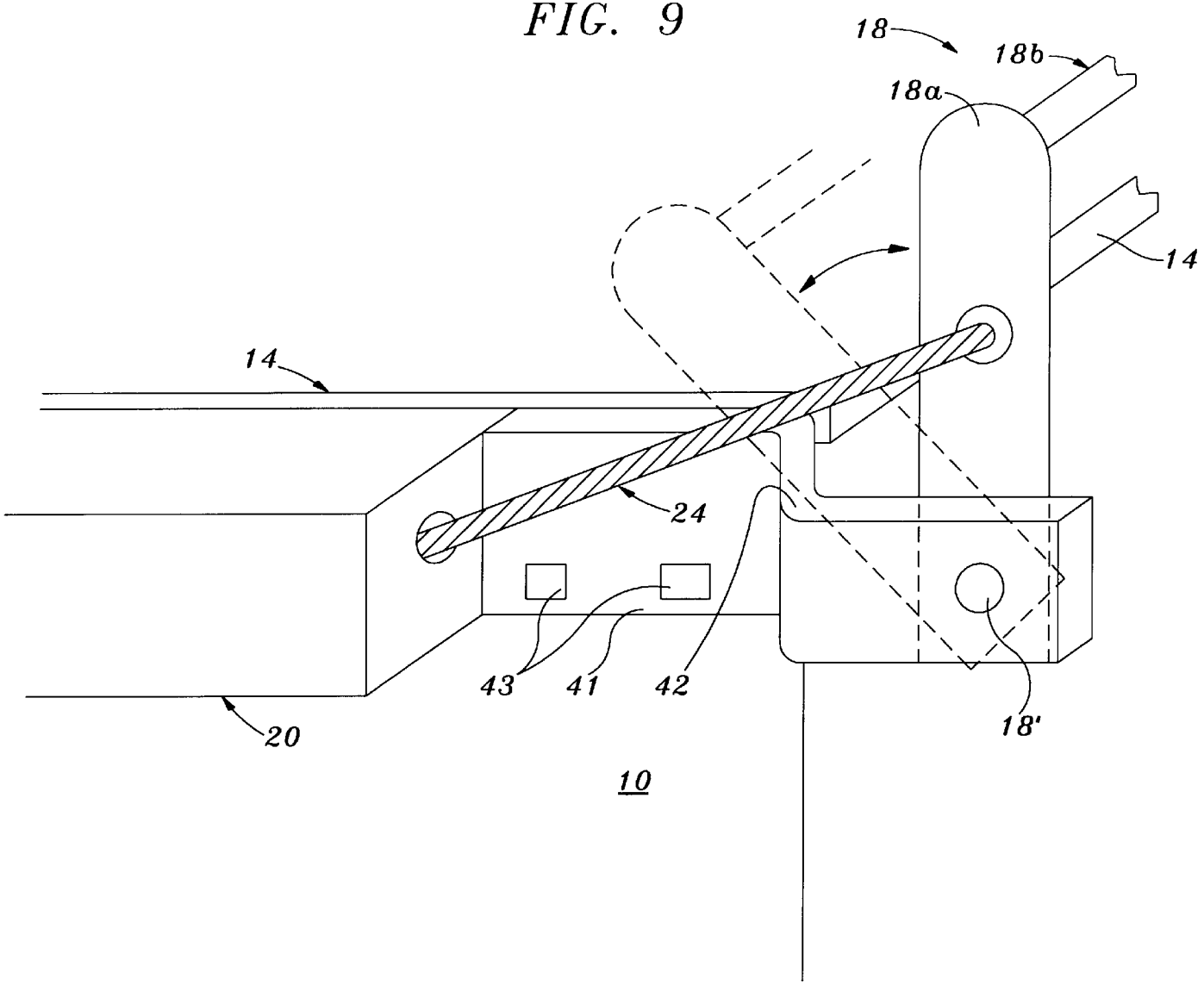
FIG. 9 is a perspective view of an alternative embodiment of the connection of the locking bar to the container.

FIG. 9 represents an alternate embodiment of the present invention. A side plate 41 is attached to the side of the container 10 adjacent the lock housing 20. The side plate 41 may be either bolted to the container through holes 43 or welded directly to the container. Such a side plate 41 facilitates easy installation of the lock bar 18 in the proper position and orientation of the pivot pin thus reducing human error during installation. The side plate 41 has an offset bend 42 to position the pivot point 18' away from the side of the container 10. The offset bend 42 provides a stop to prevent the lock bar 18 from rotating such that bar 18*b* can not come in contact with the container lid 14.

To install the lock bar, the side plate 41 is aligned adjacent the lock housing 20 and simply welded or bolted to the side of the container 10. The length of the side plates is predetermined to position the lock bar 18 and pivot point 18' such that the lock bar can pivot from an opened position and a closed position as indicated by the solid and dashed lines of FIG. 9.

A second side plate 41 is also installed on the opposite side of the container for connection to a second pivoting lever 18*b*. This second arrangement mirrors the side plate arrangement as previously discussed and will not be embellished here. Having two pivoting levers 18*a* provides significant structurally integrity to the locking bar 18*b*.

Two side plates 41, pivot levers 18*a* and locking bar 18*b* may be provided as a kit to replace locking bar connections on containers already having a lock housing 20 installed thereon or to a different locking housing. In this embodiment the side plates 41 are separate members from the lock housing. Such a configuration not only provides the ability to separately connect the locking bar and lock housing 20, but allows greater flexibility in packaging and shipping as the overall length of any one piece is reduced. However, in another embodiment, such as in new installations, one of the side plates 41 may be integrally formed with the lock housing 20. While such an embodiment may increase the overall length of the lock housing, the ease of installation is significantly reduced. Each of these embodiments may be fitted with a connector 19 for installation of a manual locking device to allow the locking bar 18 to be released from the lock 20.

While the embodiment depicted in FIG. 9 does not include a connector 19, to allow a padlock to be installed to facilitate manual release of the locking bar 18, such may be simply included as an intermediate connection between the cable 24 and pivoting lever 18*a*. The embodiment of FIG. 9 facilitates proper orientation of the pivot point 18' with respect to the lock housing 20 while providing a pivot stop 42 to prevent the locking bar 18*b* from coming in contact with the container lid 14. Additionally, a solid bar may be substituted for cable 24, such as that depicted in FIGS. 10 and 11.

Figures 10A, 10B:
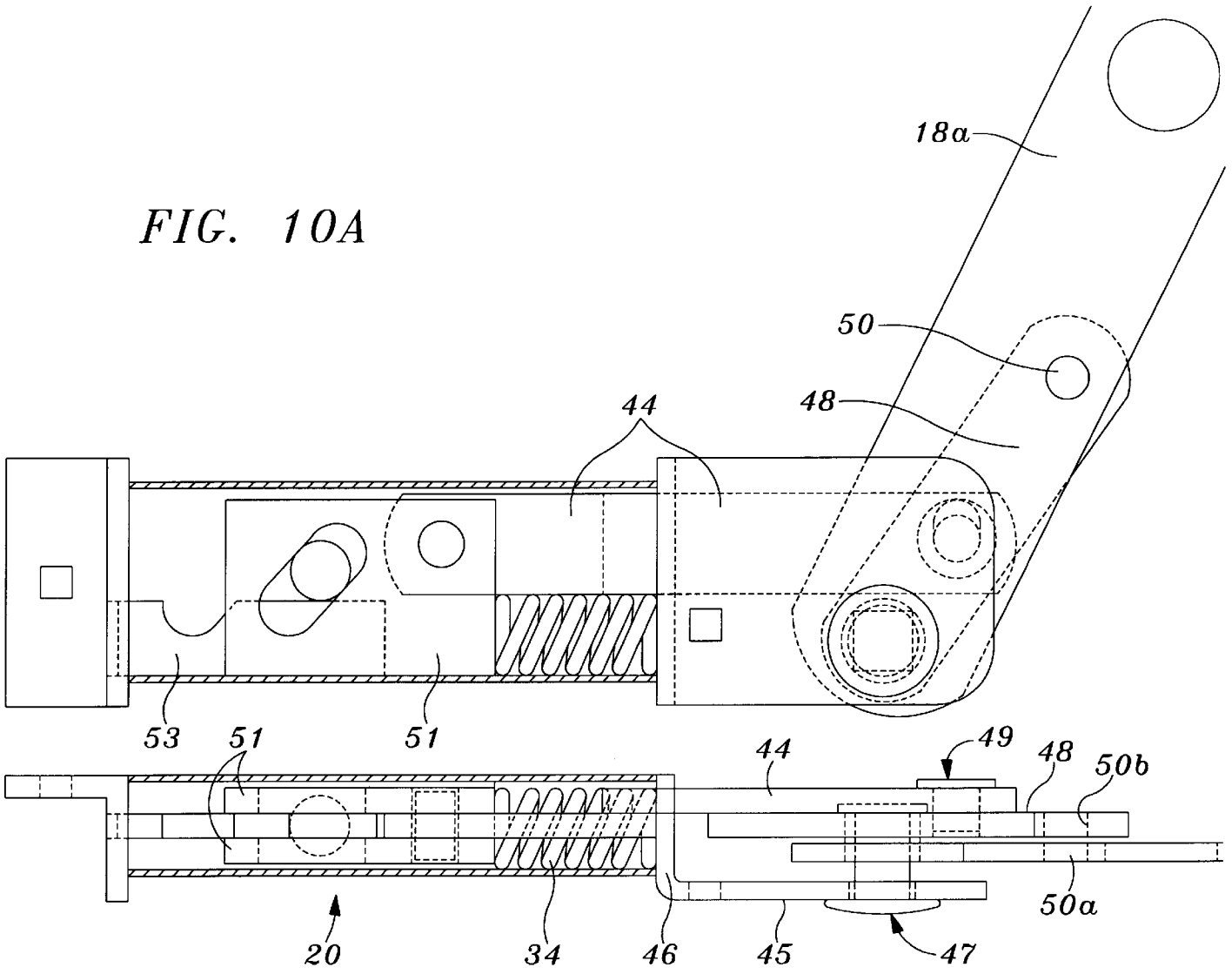
FIGS. 10A, 10B are side ant top partial sectional views of an alternative locking bar arrangement in an opened position.

FIGS. 10A, 10B and 11A, 11B represent yet an additional alternative embodiment of the present invention. In this embodiment the cable 24 is replaced by a rigid member 44. As in the embodiment of FIG. 9, a side plate 46 is provided which is offset from the side of the container 10. Preferably, the side plate 45 is integrally formed with the lock housing 20 but may be separately connected to the container 10 if desired. Pivoting lever 18*a* is pivotably connected to the side plate 45 about pivot pin 47. An intermediate lever 48 is also pivotably connected about pivot pin 47. Rigid member 44 , extending from lock housing 20 is pivotally connected to the intermediate member about pivot pint 49. As can be seen in FIG. 10*b,* the intermediate lever 48 is disposed between rigid member 44 and pivot lever 18*a*. Pivot lever 18*a* and intermediate lever 48 each have respective bores 50*a,* and 50*b* which are aligned to received a member to positively connect the pivot lever 18*a* and intermediate lever 48 together to allow tandem rotation about pivot pin 47. In the preferred embodiment, a padlock is inserted through bores 50*a,* 50*b* to lock these levers to one another.

When such a lock, or other member, is disposed through bores 50*a,* 50*b,* rotation of pivot lever 18*a,* and consequently intermediate lever 48, will cause rigid member 44 to longitudinally translate. However, when such a lock member is removed from the bores, pivot lever 18*a* is free to rotate about pivot pin 47 without effecting rigid member 44. Such an arrangement allows releasement of the locking bar to pivot allowing the opening of the container lid 14 when the lock housing 20 is in the locked position. This cooperating lever arrangement, as depicted in FIGS. 10*a,* 10*b* and 11*a,* 11*b,* reduces the required length of the side plate 45.

In this embodiment slight modifications may be maid to the lock arrangement within the housing 20. In this embodiment, the rigid member is pivotably and positively connected to and between two slide plates 51. Guide member 53 is disposed between the slide members 51. In this embodiment, the spring 34 biases the two slide plates 51 into the locked position. Otherwise, the function of the lock 20 remains substantially the same as in the previous embodiments. Preferably, rigid member 44 is made of two rigid bars connected to one another in an offset fashion. Having the two members offset from one another allows tension to be centrally applied between slide plates 51 while providing room to accommodate the intermediate lever 48 between the rigid member 44 and the pivot lever 18*a*. However, it should be understood, that the present invention is not limited to such a specific arrangement.

Figures 11A, 11B:
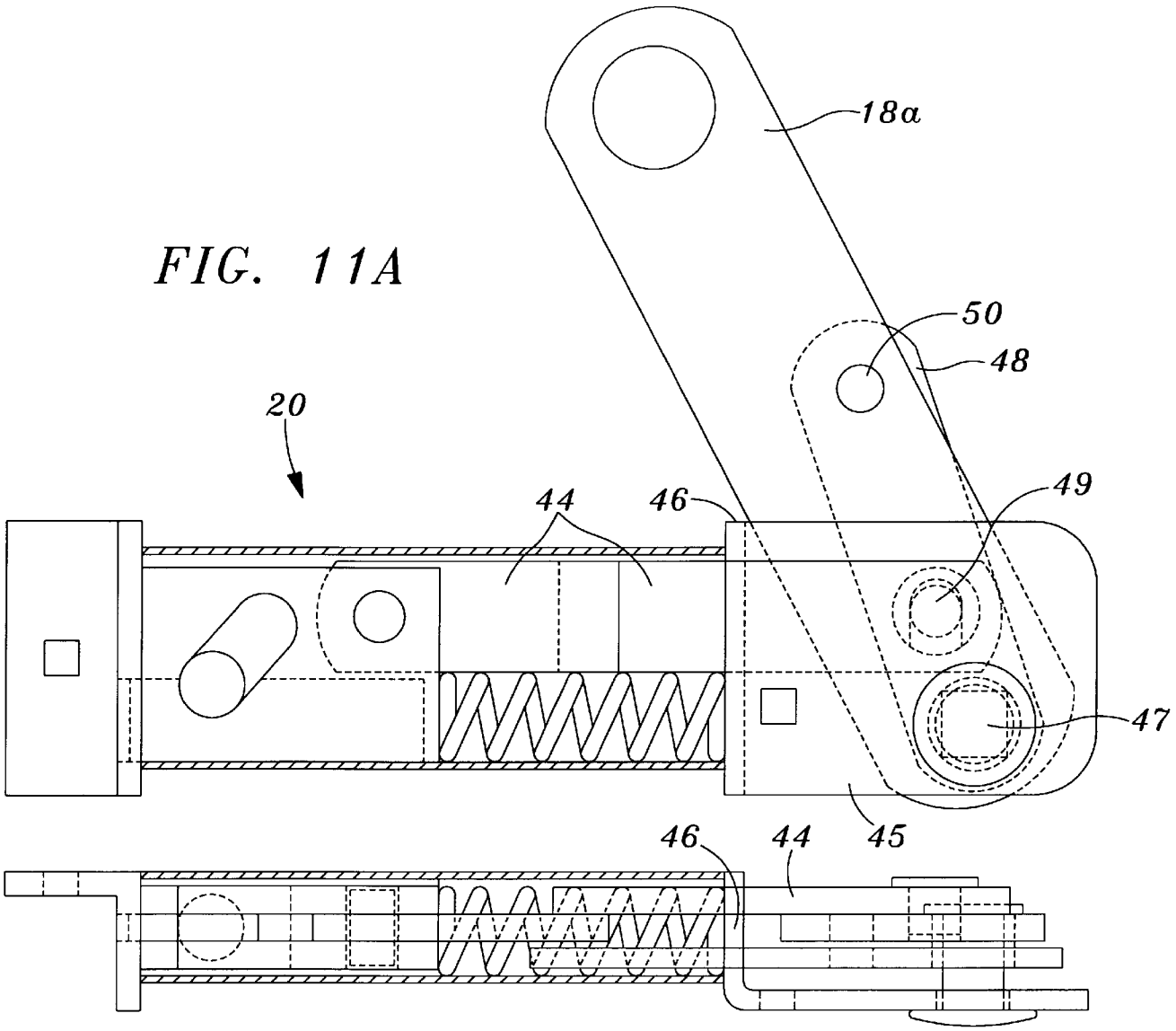
FIGS. 11A, 11B are side ant top partial sectional views of the alternative locking bar arrangement of FIGS. 10A, 10B in a closed position.

As demonstrated in FIGS. 11A, and 11B, a stop portion 46 of side plate 45 limits the rotation of pivot lever 18*a*. This arrangement, as in the embodiment of FIG. 9, prevents the locking bar from contacting the container lid 14.

The embodiment of FIGS. 10 and 11, not only provide very simple installation of the lock device, but also reduces the required length of both the side plate 45, and length of the spring 34 and associated housing 20. This embodiment also provides a positive stop to prevent the locking bar 18 from contacting the container lid 14. Such an arrangement, in addition to requiring less material, is easier to package and ship. Thus manufacturing and shipping costs are greatly reduced.

While the foregoing invention has been shown and described with reference to a preferred embodiment, it will be understood by those possessing skill in the art that various changes and modifications may be made without departing from the spirit and scope of the invention.

What is claimed is:

1. A combination automatic pivoting locking mechanism and a container having a hinged lid, said locking mechanism comprising:

a locking arm mounted for movement with respect to said lid between an open position and a closed position, said locking arm adapted to interfere with a movement of said hinged lid in said closed position;

a locking means for automatically locking said locking arm in said closed position when said container is in a substantially level position, said locking means being moved from a locking location to an unlocking location by gravitational force when said container is tilted to a predetermined angle;

a stop for limiting the rotational movement of said locking arm to prevent said locking arm from contacting said hinged lid, wherein said stop is fixed in non-rotatable position with respect to said container; and a side plate secured substantially flush against a side container, said side plate having a first portion extending away from said side of said container and a second portion outwardly offset form said side of said container, said first portion defining said stop, wherein said locking arm is rotatably secured to said second portion.

2. A combination container and a locking bar assembly for preventing a hinged lid of said container from opening; said locking bar assembly comprising:

a pair of side plates mounted to opposite sides of said container, at least one of said side plates having an offset bend defining a stop and a portion outwardly offset from said side of said container, said stop being fixed in non-rotatable position with respect to said container, a pair of pivoting levers one each pivotably mounted to said pair of side plates, a locking bar disposed between and secured to each of said pivoting levers, such that when said pivoting levers are rotated between an open and closed position said locking bar respectively allows and prevents said hinged lid from opening; wherein said stop limits rotation of said pivoting levers and locking bar to prevent said locking bar from contacting said hinged lid.

3. The combination according to claim 2, wherein said locking bar further comprises:

an intermediate lever; and a rigid member; wherein, said intermediate lever is rotatably mounted to a corresponding one of said pivoting levers, said rigid member is rotatably mounted to said intermediate member and connected to a locking means, said locking bar assembly including a means to selectively prevent and allow relative rotational movement between said corresponding pivoting lever and said intermediate lever such that when said relative rotational movement is prevented and when said corresponding pivoting lever is pivoted said rigid member translates to engage said locking means, and when said relative rotational movement is allowed said corresponding pivoting lever may pivot without engagment of said locking means.

4. The combination according to claim 3, wherein said means to selectively prevent relative rotational movement between said intermediate lever and said corresponding pivoting lever comprises:

a pair of aligned bores one each disposed through said intermediate and corresponding pivoting levers;

and a locking member which when disposed within each of said aligned bores prevents said relative rotational movement and when removed from one of said aligned bores allows said relative rotational movement.

5. The combination according to claim 2, wherein said locking bar further comprises:

an intermediate lever; and a rigid member; wherein, said intermediate lever is rotatably mounted to a corresponding one of said pivoting levers, said rigid member is rotatably mounted to said intermediate member and connected to a locking means, said intermediate lever and corresponding pivoting lever each having an aligned bore such that when a locking member is disposed within each of said bores and when said corresponding pivoting lever is pivoted said rigid member translates to engage said locking means, and when said locking member is removed from at least one of said aligned bores, said pivoting lever may pivot without engagment of said locking means.

6. A combination automatic locking mechanism and container having a hinged lid, said combination comprising:

a pair of side plates each having a first and second substantially planar portions and an offset bend disposed between and connecting said first and second planar portions such that said first and second planar portions are substantially parallel to and offset from one another, said pair of side plates being non-rotatably secured to opposite sides of said container adjacent said hinged lid such that said first planar portions lie substantially flush against said container and said second planar portions lie laterally offset and parallel to said container;

a pair of pivoting levers each pivotably attached to a corresponding one of said second planar portions of said side plates;

a locking bar disposed between and secured to said pivoting levers, wherein said pivoting levers and locking bar may pivot between an open and closed position to respectively allow and prevent said hinged lid from opening, at least one of said offset bends defining a stop to limit rotation of said pivoting levers and locking bar toward said hinged lid in said closed position to prevent said locking bar from contacting said hinged lid; and a locking means for automatically locking said pivot levers and locking bar in said closed position when said container is in a substantially level position, said locking means being moved from a locking location to an unlocking location by gravitational force when said container is tilted.

* * * * *